US006403183B1

(12) United States Patent
Iwamiya et al.

(10) Patent No.: US 6,403,183 B1
(45) Date of Patent: Jun. 11, 2002

(54) COATED MATERIALS, AND FILMS, SHEETS AND THE LIKE FOR PACKING FOODS USING THEM

(75) Inventors: Yoko Iwamiya; Kazuhiko Goda, both of Kanagawa (JP)

(73) Assignee: Kazari-Ichi Co., Ltd., Kanagawa (JP)

( * ) Notice: Subject to any disclaimer, the term of this patent is extended or adjusted under 35 U.S.C. 154(b) by 0 days.

(21) Appl. No.: 09/572,652

(22) Filed: May 16, 2000

(30) Foreign Application Priority Data

| | | |
|---|---|---|
| Jun. 9, 1999 | (JP) | 11-162811 |
| Apr. 20, 2000 | (JP) | 2000-119176 |
| May 10, 2000 | (JP) | 2000-136906 |

(51) Int. Cl.[7] ..... B32B 29/06

(52) U.S. Cl. ..... 428/36.92; 428/35.7; 428/447; 428/34.2; 428/34.3; 106/287.14

(58) Field of Search ..... 428/447, 34.2, 428/34.3, 36.92, 35.7; 106/287.14

(56) References Cited

U.S. PATENT DOCUMENTS

| | | | | |
|---|---|---|---|---|
| 3,671,485 A | * | 6/1972 | Marwitz et al. | 260/33.4 SB |
| 4,624,900 A | | 11/1986 | Fau | |
| 5,160,768 A | * | 11/1992 | Antoon, Jr. | 428/35.2 |
| 5,858,280 A | | 1/1999 | Zhang et al. | |

FOREIGN PATENT DOCUMENTS

| | | |
|---|---|---|
| GB | 2 160 539 | * 12/1985 |
| WO | WO 98/22654 | 5/1998 |
| WO | 98/22654 | * 5/1998 |

OTHER PUBLICATIONS

Z. Zhang, Langmuir, vol. 13, pp. 473–476, "Catalytic Effect of Aluminum Acetylacetonate on Hydrolysis and Polymerization of Methyltrimethoxysilane," 1997.

* cited by examiner

*Primary Examiner*—Margaret G. Moore
(74) *Attorney, Agent, or Firm*—Oblon, Spivak, McClelland, Maier & Neustadt, P.C.

(57) ABSTRACT

A coated material comprising a paper substrate or a fiber substrate and a polymer membrane having a polysiloxane structure as the main structure provided on the surface of at least one side of the substrate, and a film or sheet for packing foods and a food container made of the coated material.

15 Claims, No Drawings

COATED MATERIALS, AND FILMS, SHEETS AND THE LIKE FOR PACKING FOODS USING THEM

INDUSTRIAL FIELD OF THE INVENTION

The present invention relates to a coated material wherein a paper substrate such as cellophane paper, Japanese paper or foreign paper, or a fiber substrate such as non-woven fabric or cloth is used as the substrate, and a polymer membrane having a polysiloxane structure as the main structure is provided on the surface of at least one side of the substrate, which abounds in insulating properties and water repellency, has an appropriate strength and good light transmission properties, furthermore is rich in flame retardancy. The present invention also relates to a film or sheet for packing foods or a food container wherein paper or fiber mentioned above is used as the substrate and the polymer membrane having a polysiloxane structure as the main structure is provided at lease one side of the substrate, which abounds in insulating properties and water repellency, has an appropriate strength and good light transmission properties, furthermore is rich in flame retardancy. Further, the present invention relates to a protective cover for liquid crystal surface of an electronic device, a transparent article of stationery such as a clear holder or film case, a transparent container for an aromatic or a water repellent sheet for an automobile side mirror which is produced by fabrication of said film or sheet for packing foods, which abounds in insulating properties and water repellency, has an appropriate strength and good light transmission properties, furthermore is rich in flame retardancy.

BACKGROUND OF THE ART

Paper materials with a laminated surface or with a resin-coated surface are conventionally used in various fields. To exemplify a part of such materials often used for house building, for example, for a shoji sliding door as a open-close partition of Japanese rooms, rayon shoji paper produced by mixing rayon and polypropylene in a predetermined ratio, a shoji paper which is made by laminating a plastic film on the rayon shoji paper and shoji paper which is made by laminating an acrylic or vinyl chloride material on a Japanese paper surface have been used.

Other than such kinds of paper materials, sheet materials such as plastic sheet and vinyl sheet which generally have high light transmission properties as well as excellent water repellency have been known.

Also, polyvinylidene chloride (PVDC) has been in heavy usage of a film or sheet for packing foods due to its excellent oxygen barrier property.

Further, as a food container, for example, expanded polystyrene is used as a container for cup noodle or the like and, it is used, for example, a drawn transparent polypropylene resin-made container as a container for packing food which is subjected to microwave oven cooking.

PROBLEMS RESIDE IN THE PRIOR ART

There is a problem that the conventional paper materials except for paraffin paper, cellophane and the like cannot be used for a product required for light transmission properties, because of no light transmission properties. Further, these conventional paper materials are highly hygroscopic and insufficient in their strengths.

While the rayon shoji paper mentioned above and the like can dissolve the above problem to a certain degree, it is apt to generate static electricity, there being alternative problem that it is inclined to adsorb dust. Further, although the material itself is relatively resistant to water, there also is a problem that when wiped the dust off with a wet dustcloth, the material absorbs moisture so that the adhesive surface is inclined to peel off.

The plastic and vinyl sheets mentioned above and the like exhibit light transmission properties and water repellency higher than the papers. However, they are produced from a factory, therefore, it is very difficult to replace with the factory products furnishing goods such as a shoji sliding door as a open-close partition of Japanese rooms, which is given weight to quality and the like of the material. Further, in the plastic sheet, vinyl sheet and the like, in addition to the above problems, there is fear that when incinerated or the like, compounds acting as so-called environmental hormone or dioxin are generated due to various additives contained therein.

On the other hand, in the conventional film or sheet for packing foods, there is also fear that when incinerated or the like, compounds acting as so-called environmental hormone or dioxin are generated due to chloride atoms and the like contained therein because they are made of PVDC. In particular, plasticizers added thereto in order to improve workability is suspected of acting as an environmental hormone.

Also, in respect to expanded polystyrene used for cup noodle container and the like, or polypropylene resin used for food-packing containers which are subjected to microwave cooking, it is feared that styrene dimer and the like, which are suspected of being as environmental hormones are eluted from them. In particular, since there are cases where foods in food containers for microwave oven cooking are subjected to heating at higher than 200° C., it is required a new food container which can be used in microwave oven cooking at higher temperature by taking place of polypropylene resin having a melting point of approximately 160° C.

Thus, in the light of requirements for novel paper substrates for making furnishing goods and recent strict status with regard to global environment, environment-friendly materials useful for such paper materials, food-packing films and food containers are required.

PROBLEM TO BE SOLVED BY THE INVENTION

In the light of the problems concerning the conventional paper materials mentioned above, the first object of the present invention is to provide a coated material wherein a paper substrate such as cellophane paper, Japanese paper or foreign paper, or a fiber substrate such as non-woven fabric or cloth which is excel in quality as furnishing goods, is used as a substrate, which abounds in insulating properties and water repellency, has an appropriate strength and good light transmission properties, further is rich in flame retardancy.

Also, the second object of the present invention is to provide a film or sheet for packing foods made of the above mentioned coated material, which abounds in the insulating properties and water repellency, has an appropriate strength and good light transmission properties, is rich in flame retardancy, further has an oxygen barrier property, as well as is free from care about environmental hormones.

Further, the third object of the present invention is to provide a food container which has oxygen barrier property and is free from care about environmental hormones, and particularly, to provide a transparent food container which can be used as one wherein food in the container is subjected to microwave oven cooking at a higher temperature than 200° C.

Furthermore, the fourth object of the present invention is to provide an articles made of the above film or sheet for packing foods, including a protective cover for liquid crystal surface of an electronic device, a transparent article of stationery such as a clear holder or a film case, a transparent container for an aromatic or a water repellent sheet for an automobile side mirror, etc.

SUMMARY OF THE INVENTION

The present invention firstly accomplishes the first object mentioned above by providing a coated material having constitutions (1) to (5) as follows:

(1) a coated material comprising a substrate made of paper or fiber, and a polymer membrane having a polysiloxane structure as the main structure provided on the surface of at least one side of said substrate;

(2) a coated material, wherein said polymer membrane having a polysiloxane structure as the main structure is one made from a coating liquid comprising an alkoxysilane of the general formula (1):

(1)

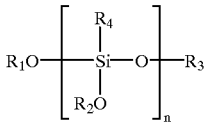

(wherein, $R_1$, $R_2$, $R_3$ and $R_4$ are, the same or different with each other, a hydrogen atom or an alkyl group having 1 to 4 carbon atoms and n is an integer of 2 to 8.);

(3) a coated material, wherein said coating liquid comprises an alkoxysilane of said general formula (1) and an alkoxysilane of the general formula (2) in which three substituents out of four are hydrolyzable groups and residual one substituent is a non-hydrolyzable group:

(2)

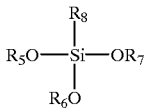

(wherein $R_5$, $R_6$ and $R_7$ are, the same or different with each other, a hydrogen atom, an alkyl group having 1 to 10 carbon atoms or an alkenyl group having 1 to 10 carbon atoms, or $R_5O$, $R_6O$ and $R_7O$ represent siloxane bonds, respectively, and $R_8$ is an alkyl, alkenyl or phenyl group which may include an epoxy group or a glycidyl group in the group.)

(4) a coated material, wherein said polymer membrane having a polysiloxane structure as the main structure is one made from said coating liquid with the use of a catalyst consisting of a hydrolyzable organometal compound; and (5) a coated material, wherein said hydrolyzable organometal compound is one containing a metal component selected from the group consisting of titanium, zirconium, aluminum and tin.

The present invention then accomplishes the second object mentioned above by providing a film or sheet for packing foods having the constitutions (6) to (11) as follows:

(6) a film or sheet for packing foods comprising a substrate made of paper or fiber, and a polymer membrane having a polysiloxane structure as the main structure provided on the surface of at least one side of said substrate;

(7) a film or sheet for packing foods, wherein said polymer membrane having a polysiloxane structure as the main structure is one made from a coating liquid comprising an alkoxysilane of the general formula (3):

$$R_{9X}Si(OR_{10})_{4-X} \quad (3)$$

(wherein, $R_9$ and $R_{10}$ are, the same or different with each other, a hydrogen atom or an alkyl group, an aryl group, an alkenyl group or a substituted group thereof and X is an integer of 0 to 2.);

(8) a film or sheet for packing foods, wherein said polymer membrane having a polysiloxane structure as the main structure is one made from a coating liquid comprising an alkoxysilane of said general formula (1);

(9) a film or sheet for packing foods, wherein said coating liquid comprises an alkoxysilane of said general formula (1) and an alkoxysilane of said general formula (2) in which three substituents out of four are hydrolyzable groups and residual one substituent is a non-hydrolyzable group;

(10) a film or sheet for packing foods, wherein said polymer membrane having a polysiloxane structure as the main structure is one made from said coating liquid with the use of a catalyst consisting of a hydrolyzable organometal compound; and

(11) a film or sheet for packing foods, wherein said hydrolyzable organometal compound is one containing a metal component selected from the group consisting of titanium, zirconium, aluminum and tin.

The present invention then accomplishes the third object mentioned above by providing a food container having the constitutions (12) to (17) as follows:

(12) a food container comprising a substrate made of paper or fiber, and a polymer membrane having a polysiloxane structure as the main structure provided on the surface of at least one side of said substrate;

(13) a food container, wherein said polymer membrane having a polysiloxane structure as the main structure is one made from a coating liquid comprising an alkoxysilane of said general formula (3);

(14) a food container, wherein said polymer membrane having a polysiloxane structure as the main structure is one made from a coating liquid comprising an alkoxysilane of said general formula (1);

(15) a food container, wherein said coating liquid comprises an alkoxysilane of said general formula (1) and an alkoxysilane of said general formula (2) in which three substituents out of four are hydrolyzable groups and residual one substituent is a non-hydrolyzable group;

(16) a food container, wherein said polymer membrane having a polysiloxane structure as the main structure is one made of said coating liquid by the use of a catalyst consisting of a hydrolyzable organometal compound; and

(17) a food container, wherein said hydrolyzable organometal compound is one containing a metal component selected from the group consisting of titanium, zirconium, aluminum and tin.

Further, the present invention accomplishes the fourth object mentioned above by processing the above film or sheet for packing foods in accordance with the constitutions (18) and (19) as follows:

(18) a protective cover for liquid crystal surface of an electronic device made by cutting the film or sheet for packing foods having a predetermined thickness into a predetermined size; and

(19) a transparent pouched article of stationery such as a clear holder or a film case, a transparent container for an aromatic or a water repellent sheet for an automobile side mirror made by cutting the film or sheet for foods having a predetermined thickness into a predetermined size.

MODE FOR CARRYING OUT THE INVENTION

The present invention is described in detail below.

Firstly, explanations are given with respect to the coated material provided for accomplishment of the first object of the present invention.

The coated material of the present invention using a paper substrate such as cellophane, Japanese paper or foreign paper, or a fiber substrate such as non-woven fabric or cloth as the substrate, can simultaneously solve the problem in the surface coating technique with the so-called "sol-gel process" which is employed in the conventional coating technique of substrates. Sol-gel liquid used in the coating of the so-called sol-gel process, is usually one which has a tetraalkoxysilane as the main reactive agent and organic substituents introduced with an aim to impart water repellency thereto.

In this case, the main reactive agent of tetraalkoxysilane exhibits strong inorganic characteristics, therefore, in order to introduce organic substituents to the main chain, so-called silane coupling agents represented by phenylalkoxysilane frequently used to accomplish the aim mentioned above.

However, the so-called silane coupling agents are expensive and unless they are used to a certain large amount, it is difficult to achieve the above effect. Adversely, when used in large quantities, the significant difference in the rate of hydrolysis between a silane coupling agent and the main reactive agent of tetraalkoxysilane causes the reaction to be apt to proceed with non-uniformly, whereby there is a problem that the strength of the resulting coated membrane (polymer membrane) significantly deteriorates.

To overcome this drawback, so-called organic-inorganic composite materials with organic substituents directly introduced to silane atoms can be synthesized and employed. Whereas by the use of the organic-inorganic composite material the aim mentioned above can fully be accomplished, the composite material is difficult to synthesize them, hence it follows that they are expensive materials. The coated material is a novel one completed with the present applicant's efforts, which can overcome the above-mentioned drawbacks of the conventional art.

The coated material of the present invention is characterized in that a polymer membrane having a polysiloxane structure as the main structure is provided on the surface of at least one side of a paper substrate such as cellophane paper, Japanese paper or foreign paper, or a fiber substrate such as non-woven fabric or cloth. Namely, in more detail, the substrate mentioned above with or without undergoing preliminary treatment is coated with the alkoxysilane-base coating liquid, followed by curing and solidifying with the action of a catalyst to impart the coated material insulating properties, water repellency, appropriate strength, good light transmission properties and flame retardancy.

The alkoxysilanes as the main component of the alkoxysilane-base coating liquid include, for example, the above-mentioned compound of the general formula (1), (where in the general formula (1), $R_1$, $R_2$, $R_3$ and $R_4$ are, the same or different with each other, a hydrogen atom or an alkyl group having 1 to 4 carbon atoms and n is an integer of 2 to 8).

Such alkoxysilanes can readily be obtained by condensation of monomers (such as methyltrimethoxysilane). As the row material of the alkoxysilane-base coating liquid, monomers such as methyltrimethoxysilane can be employed as it is, however, in such cases, polymerization takes long time. To obtain a polymer membrane having the above-mentioned characteristics in short time, it is preferred to use a condensate prepared by the condensation of the monomers. However, if the polymerization degree of condensate is too high, number of the alkoxy groups used for polymerization carried out on the substrate after coating runs short, which tends to bring insufficient strength etc. to the formed polymer membrane.

Accordingly, in order to impart to the coated material insulating properties, water repellency, appropriate strength, good light transmission properties and flame retardancy to a moderate degree, it is preferred to use a condensate having a polymerization degree of 2 to 8. As compared with tetraalkoxysilanes which are inexpensive but are not available as they are due to their strong inorganic characteristics, the monomer which is raw material of the above-mentioned condensate has in its molecule a substituent $R_4$ which is not hydrolyzed so that $R_4$ is left as it is in the resultant coating membrane. This $R_4$ has substantial organic characteristics, and can impart the polymer membrane sufficient insulating effect, water repellency, an appropriate strength and good light transmission properties. The monomer can be purchased at a low price equal to the tetraalkoxysilanes. Thus, according to the present invention, it is unnecessary to dare to use the expensive, so-called silane coupling agent, the polymer membrane can be obtained which has sufficient organic characteristics, and sufficient insulating properties, water repellency, appropriate strength, good light transmission properties and flame retardancy.

With an aim to further increase the organic characteristics and the like of the polymer membrane formed by coating with the coating liquid mentioned above, various alkoxysilanes which are different from the main component of alkoxysilane, may be added to the coating liquid mentioned above. The alkoxysilanes added in order to accomplish such an aim include one in which three substituents out of four substituents are hydrolyzable groups and residual one substituent is a non-hydrolyzable group, as represented by the general formula (2) wherein $R_5$, $R_6$ and $R_7$ are, the same or different with each other, a hydrogen atom, an alkyl group having 1 to 10 carbon atoms or an alkenyl group having 1 to 10 carbon atoms, $R_5O$, $R_6O$ and $R_7O$ represent siloxane bonds, respectively, and $R_8$ is an alkyl; alkenyl or phenyl group which may include an epoxy group or a glycidyl group in the group.).

Specifically, examples of the alkoxysilanes of the general formula (2) include, for example, methyltrimethoxysilane, ethyltrimethoxysilane, propyltrimethoxysilane, vinyltrimethoxysilane, phenyltrimethoxysilane, γ-(methacryloxypropyl) trimethoxysilane, γ-glycidoxypropyltrimethoxysilane, aminopropyltrimethoxysilane, β-(3,4-epoxycyclohexyl) ethyltrimethoxysilane, methyltriethoxysilane, ethyltriethoxysilane, propyltriethoxysilane, vinyltriethoxysilane, phenyltriethoxysilane, γ-(methacryloxypropyl)triethoxysilane, γ-glycidoxypropyltriethoxysilane, aminopropyltriethoxysilane, vinyltris(β-methoxyethoxy) silane.

These alkoxysilanes may be added solely or in combination of two or more. They may also be added as the monomer or condensate thereof In the case where the condensate is employed, it may be a condensate consisting of single or plural monomer species.

It is important that various alkoxysilanes which are different from the main component of the alkoxysilane of the general formula (1) and which are added with the aim to further increase the organic characteristics and the like of the polymer membrane formed by coating with the coating liquid mentioned above, are added in an amount less than 50% by weight relative to the alkoxysilane of the general formula (1) as the main component of the coating liquid. When they are added in an amount more than 50% by weight, binding with the main component of the alkoxysilane of the general formula (1) could not successfully proceed upon applying the coating liquid on the surface of the substrate so that there is the possibility of deterioration of the strength of the polymer membrane.

Catalysts generally used can be employed to cure and solidify a combination of the alkoxysilane of the general formula (1) as the main component of the coating liquid and the alkoxysilane of the general formula (2) which is added as occasion requires. Acid catalysts include, for example, hydrochloric acid, nitric acid, sulfuric acid, phosphoric acid, formic acid, acetic acid. Also, basic catalysts include, for example, ammonia, tetramethylammonium hydroxide, 2-hydroxyethyltrimethylammonium hydroxide, ethanolamine, diethanolamine, triethanolamine.

When the above mentioned catalyst generally used is employed, reaction water is required for curing and solidifying the alkoxysilanes. However, mixing of the alkoxysilane, reaction water and the catalyst likely causes gelation of the coating liquid so that long-term storage of the coating liquid as a liquid form becomes difficult. Then, when it is intended long-term storage of the coating liquid as a liquid form, it is preferred to employ a catalyst consisting of a hydrolyzable organometal compound in place of the above-mentioned catalyst, because such a hydrolyzable organometal compound needs no reaction water prior to the curing and solidifying of the alkoxysilane.

Such an organometal compound includes, for example, ones consisting of titanium, zirconium, aluminum and tin. Specifically, it includes, for example, tetrapropoxytitanate, tetrabutoxytitanate, tetrapropoxyzirconate, tetrabutoxyzirconate, tripropoxyaluminate, acetylacetonatoaluminum, dibutyltin diacetate, dibutyltin dilaurate.

In order to obtain a uniform mixture, an organic solvent or surface active agent is preferably added to the mixture of the alkoxysilane of the general formula (1), the alkoxysilane of the general formula (2) which is added as occasion requires, the catalyst, and reaction water which is added as the catalyst employed requires,. Organic solvents to be used for such an aim, include, for example, alcohols. Specifically, they include, for example, methanol. ethanol, propanol, isopropanol, butanol, pentanol, hexanol and the like. They can be used alone or in combination of two or more.

Addition of the organic solvents or surface active agents mentioned below is effective to control the viscosity or drying rate of the coating liquid, in addition to the aim mentioned above. The organic solvent added with this aim, may optionally be selected which has appropriate viscosity and boiling point as occasion requires.

Further, it is possible to use them together with the above-mentioned organic solvents. Organic solvents to be added with such an aim, specifically includes, for example, glycols such as ethylene glycol, propylene glycol, diethylene glycol, polyethylene glycol, dipropylene glycol and polypropylene glycol; and cellosolves such as methoxyethanol, propoxyethanol, butoxyethanol, methoxypropanol, ethoxypropanol, propoxypropanol and butoxypropanol.

Since these glycols and cellosolves have hydroxyl groups in their molecules, there are cases where these molecules having organic nature are introduced in the network of siloxane bonds made by the condensation of these molecules and alkoxysilanes as occasion requires. Such events can bring about enhancing organic characteristics of the resultant coating membrane.

To the coating liquid, in addition to the above, filler may be added as occasion requires. Filler to be used includes, for example, silica, alumina, kaolin, mullite, zeolite, silicon carbide, silicon nitride, oxides of metal (such as titanium, iron, aluminum, cobalt, chromium, copper), metal salts (such as silver nitrate, copper nitrate (II), zinc nitrate (II), silver sulfate, copper sulfate, zinc sulfate, silver acetate, copper acetate, zinc acetate), all of which have an average particle diameter of approximately 0.03 to 5 μm; and whiskers having an average diameter of approximately 0.05 to 2 μm and an average length of approximately 5 to 200 μm (such as whiskers of potassium titanate, silicon nitride, silicon carbide).

Further, membrane curing agent, viscosity controlling agent, stabilizing agent, coloring agent or the like may be added to the coating liquid.

The coating liquid mentioned above is preferably used for application to a paper substrate or a fiber substrate after it is left to stand for one hour to one day from the preparation, or after it is heated at lower temperature than the boiling point of the solvent used.

The method of application of the coating liquid to a paper substrate or a fiber substrate is not particularly limited, and for example, methods of application such as dipping application, spray application, screen application, screen printing, offset printing and gravure printing can be employed. Then, the coating liquid is applied onto a cellophane paper in an amount such that the polymer membrane has a certain thickness mentioned below.

Further, in order to improve adhesiveness between the polymer membrane to be formed and the paper substrate or the fiber substrate, surface of the paper substrate or the fiber substrate is treated prior to application of the coating liquid. Such a pretreatment method itself is well-known in the art.

As the method of forming a polymer membrane from the coating liquid applied, heating method at a temperature of 300° C. or lower, preferably from 80 to 150° C., for about 2 minutes to one hour is generally employed. Of course it is possible to employ heating at a higher temperature than 300° C. within a range such that the paper substrate or the fiber substrate is adversely affected. Further, when the alkoxysilane contains polymerizable unsaturated bonds, it is possible to form additional cross-linking structure with the combination of the heating and UV irradiation.

Then, according to the coated material of the present invention, the polymer membrane having a polysiloxane structure as the main structure may be provided on the surface of one side or both side of a paper substrate or a fiber substrate.

Paper substrates such as cellophane paper, Japanese paper and foreign paper, or fiber substrates such as non-woven fabric and cloth which are substrates of the coated material of the present invention, have a thickness of preferably 0.01 mm or above in view of the strength. Then, thickness of the polymer membrane having a polysiloxane structure as the main structure is not particularly limited, however, for example, it is preferred from 2.5 to 25 $\mu$m in view of the oxygen barrier property and heat resistance when it is used as a film or sheet for packing foods, or a food container which is the second or third object of the present invention mentioned below.

Next, the film or sheet for packing foods, and the food container are explained which are provided to accomplish of the above mentioned second or third object of the present invention.

The film or sheet for packing foods, or the food container of the present invention is constructed by the coated material using a paper such as cellophane paper as the substrate. In particular, cellophane paper is preferably employed for package of chocolate, drug package, exterior package of candy or gum by putting its twisting property to good use. Cellophane paper is commercially available and such available one can be used. A preferred available cellophane paper includes, for example, Taiko Cellophane (brand name, manufactured by Futamura Kagaku Kogyo Kabushiki Kaisha), Hakusan (brand name, manufactured by Rengo Kabushiki Kaisha).

The film or sheet for packing foods, or the food container of the present invention is constructed by the coated material of the present invention wherein the coated material mentioned above, i.e. the polymer membrane having a polysiloxane structure as the main structure, is provided on the surface of one side or both side of a paper substrate such as cellophane paper, or a fiber substrate. The former are described hereinbefore. The latter will be explained as follows.

The polymer membrane having a polysiloxane structure as the main structure which can be formed from a coating liquid containing an alkoxysilane of the general formula (3) is as follows:

This alkoxysilane represented by the general formula (3) is hydrolyzed in the presence of water, followed by dehydration and condensation. The polymer having the polysiloxane structure is formed when such a series of the reactions sufficiently proceed. This fact is well-known by those skilled in the art.

$R_9$ in the general formula (3) includes, for example, a hydrogen atom; an alkyl group such as a methyl group, an ethyl group, a n-propyl group and an i-propyl group; an aryl group such as a phenyl group; an alkenyl group such as a vinyl group; and a substituted alkyl group such as a β-(3,4-epoxycyclohexyl)ethyl group, a γ-methacryloxypropyl group, a γ-glycidoxypropyl group, a γ-chloropropyl group, a γ-mercaptopropyl group, a γ-aminopropyl group, an N-phenyl- γ-aminopropyl group, an N-β-(aminoethyl)-γ-aminopropyl group, a trifluoromethyl group and a 3,3,3, trifluoropropyl group.

When X in the general formula (3) is 2, the two $R_9$ are the same members or a combination of two members selected from the group above. With the selection of the member of $R_9$, the properties of the resultant polymer membrane can be adjusted.

Particularly, in light of the amelioration of toughness of the polymer membrane, $R_9$ is preferably a member having a reactive group other than an alkoxy group. Preferred $R_9$ includes, for example, a vinyl group, a γ-methacryloxypropyl group and a γ-glycidoxypropyl group. By the use of such preferred $R_9$, it is obtainable the polymer membrane wherein not only the polysiloxane structure but also cross-linking structure formed by the cross-linking reaction by the reactive groups of the preferred $R_9$ are formed to ameliorate toughness of the polymer membrane.

$R_{10}$ in the general formula (3) includes, for example, a hydrogen atom; an alkyl group such as a methyl group, an ethyl group, a n-propyl group, an i-propyl group, a n-butyl group, a sec-butyl group and a t-butyl group; an aryl group such as a phenyl group; and a substituted alkyl group such as an acetyl group and a β-methoxyethoxy group.

Specific examples of the alkoxysilane of the general formula (3) include, for example, tetrahydroxysilane, tetramethoxysilane, tetraethoxysilane, methyltrimethoxysilane, methyltriethoxysilane, phenyltrimethoxysilane, phenyltriethoxysilane, vinyltrimethoxysilane, vinyltriethoxysilane, γ-methacryloxypropyltrimethoxysilane, γ-methacryloxypropyltriethoxysilane, γ-glycidoxypropyltrimethoxysilane, γ-glycidoxypropyltriethoxysilane, dimethyldimethoxysilane, dimethyldiethoxysilane, diphenyldimethoxysilane, diphenyldiethoxysilane, γ-methacryloxypropylmethyldiethoxysilane, γ-glycidoxypropylmethyldiethoxysilane, trifluoromethyltrimethoxysilane and trifluoromethyltriethoxysilane. These alkoxysilanes can be used alone or in combination of two or more.

In particular, by the use of an alkoxysilane wherein X is 1, or a combination of an alkoxysilane wherein X is 1 and an alkoxysilane wherein X is 2, it is preferred that an average of X does not exceed 2. This can make the polysiloxane structure have the three-dimensional cross-linking structure so that the, resultant polymer membrane becomes more tough.

Organic solvents used for making the coating liquid containing the alkoxysilane mentioned above include, for example, alcohols such as methanol, ethanol, propanol, butanol and 3-methyl-3-methoxybutanol; glycols such as ethyleneglycol and propyleneglycol; ethers such as ethyleneglycol monomethyl ether, propyleneglycol monomethyl ether, propylene glycol monobutyl ether and diethyl ether; ketones such as methyl isobutyl ketone and diisobutyl ketone; amides such as dimethylformamide and dimethylacetamide; acetates such as ethyl acetate, ethylcellosolve acetate and 3-methyl-3-methoxybutyl acetate; and aromatic and aliphatic carbon hydride such as toluene, xylene, hexane and cyclohexane, as well as N-methyl-2-pyrorydone, γ-butyrolactone and dimethyl sulfoxide.

In the light of amelioration of coating properties of the resultant coating liquid, a solvent having a boiling point of from 100 to 300° C. is particularly preferably used.

The solvent contained in the coating liquid is preferably used in an amount of from 0.1 to 10.0 weight part relative to one weight part of the alkoxysilane in the light of the. coating properties.

Water contained in the coating liquid in order to cause hydrolysis and condensation reaction of the alkoxysilane of the general formula (3), is preferably ion-exchanged water and preferably used in an amount of ranging from 1 to 4 moles relative to one mole of the alkoxysilane.

Further, in order to proceed with hydrolysis and condensation reaction, a catalyst may be used as occasion requires. Catalysts to be used include, for example, acid catalysts such as sulfuric acid, acetic acid, acetic anhydride, trifluoroacetic acid, formic acid, phosphoric acid, boric acid, p-toluenesulfonic acid and ion-exchange resin; and basic catalysts such as triethylamine, diethylamine, triethanolamine, diethanolamine, sodium hydroxide and potassium hydroxide. However, in the light of amelioration of toughness of the resultant coating membrane, an acid catalyst is preferred and one containing boron is particularly preferred.

The catalyst added to the, coating liquid is preferably used in an amount of ranging from 0.001 to 0.1 weight part relative to one weight part of the alkoxysilane in consideration of polymerization degree of the polysiloxane structure, life time of the coating liquid and evenness of the formed polymer membrane.

To the coating liquid mentioned above, a metal alkoxide of the general formula (4) below or a chelate compound thereof may be added.

$$M(OR_{11})_m \quad (4)$$

In the general formula (4), M is a metal atom and preferably includes, for example, titanium, zirconium, aluminum, tin or zinc, but is not limited thereto. When there is plural $R_{11}$, it is, the same or different with each other, a hydrogen atom, an alkyl group, an aryl group, an alkenyl group and substituted compound thereof. m is an atomic valence of the metal M.

The addition of the alkoxide compound of the general formula (4) denatures the polysiloxane structure which constitutes the resultant polymer membrane, by the metal oxide structure. This provides an effect of decreasing the heating temperature to form a polymer membrane having more excellent resistance to elevated temperature and humidity. In particular, zirconium alkoxide or its chelate compound is preferably used since it is effective for amelioration of toughness of the polymer membrane.

The metal alkoxide or its chelate compound mentioned above is added in an amount of preferably from 0.1 to 20 weight parts, more preferably from 0.5 to 5 weight parts relative to 100 weight parts of the alkoxysilane of the general formula (3).

In the general formula (4), $R_{11}$ includes, for example, alkyl groups such as a methyl group, an ethyl group, a n-propyl group, an i-propyl group, a sec-butyl group and a t-butyl group; aryl groups such as a phenyl group; an acetyl group; and substituted alkyl groups such as β-methoxyethoxy group.

Specifically, metal alkoxide includes, for example, tetra-(i-propoxy) titanium, tetra-(n-butoxy) titanium, tetra-(i-propoxy) zirconium, tetra-(n-butoxy) zirconium, tri-(i-propoxy) aluminum and tri-(n-butoxy) aluminum.

The chelate compound of the metal alkoxide can easily be obtained by reacting the metal alkoxide of the general formula (4) with a chelating agent.

Chelating agents include, for example, β-diketones such as acetylacetone, benzoylacetone and dibenzoylmethane; and esters of β-keto acid such as ethyl acetoacetate and ethyl benzoylacetate.

The metal alkoxide reacts with a chelating agent in a various chemically theoretical amount to give a corresponding metal chelate compound, therefore, the amount of the chelating agent to be used may be selected within a range of from 0.1 to 10 moles relative to one mole of the metal alkoxide.

The reaction solvent to be used for the reaction of the metal alkoxide and the chelating agent is one which can form an azeotropic mixture with an alcohol generated during the reaction and is preferably one which is undergone dehydration. Such solvents include, for example, alcohols such as methanol, ethanol, propanol, butanol and 3-methyl-3-methoxybutanol; glycols such as ethyleneglycol and propyleneglycol; ethers such as ethyleneglycol monomethyl ether, propyleneglycol monomethyl ether, propyleneglycol monobutyl ether and diethyl ether; ketones such as methyl i-butyl ketone and di-i-butyl ketone; amides such as dimethylformamide and dimethylacetamide; acetates such as ethyl acetate, ethylcellosolve acetate and 3-methyl-3-methoxybutyl acetate; and aromatic and aliphatic carbon hydrides such as toluene, xylene, hexane and cyclohexane; as well as N-methyl-2-pyrrolidone, γ-butyrolactone and dimethyl sulfoxide. The amount of the solvent may optionally be selected but preferably within a range of from 1 to 50.0 weight parts relative to one weight part of the metal alkoxide.

Further, the reaction temperature is selected within a range of from solidifying point to boiling point of the reaction solvent. The reaction is preferably carried out under nitrogen atmosphere.

The coating liquid mentioned above is prepared in the form of a solution wherein the alkoxysilane of the general formula (3), water, a catalyst added to proceed with hydrolysis and condensation reaction, and, if necessary, the metal alkoxide of the general formula (4) or the metal chelate compound derived from the metal alkoxide are dissolved in an organic solvent as mentioned above, preferably one having a boiling point of from 100 to 300° C. As preparation method, after mixing at an ordinary temperature, it is preferred that the mixture is left to stand for about one hour to one day or that the mixture is heated at the boiling point of the solvent or below for several hours.

Further, to the coating liquid, filler may be added as occasion requires. Filler to be used includes, for example, silica, alumina, kaolin, mullite, zeolite, silicon carbide, silicon nitride, oxides of metal (such as titanium, iron, aluminum, cobalt, chromium, copper), metal salts (such as silver nitrate, copper nitrate (II), zinc nitrate (II), silver sulfate, copper sulfate, zinc sulfate, silver acetate, copper acetate, zinc acetate), all of which have an average particle diameter of approximately 0.03 to 5 μm; and whiskers having an average diameter of approximately 0.05 to 2 μm and an average length of approximately 5 to 200 μm (such as whiskers of potassium titanate, silicon nitride, silicon carbide).

Further, to the coating liquid, a membrane curing agent, a viscosity modifier, a surface active agent, a stabilizing agent, a coloring agent or the like may be added.

The method of application of the coating liquid to a paper substrate or fiber substrate is not particularly limited, and for example, methods of application such as dipping application, spray application, screen application, screen printing, offset printing and gravure printing can be employed. Then, the coating liquid is applied onto a cellophane paper in an amount such that the polymer membrane has a certain thickness mentioned below.

Further, in order to improve adhesiveness between the polymer membrane to be formed and a paper substrate or a fiber substrate, surface of the paper substrate or the fiber substrate is treated prior to application of the coating liquid. Such a pretreatment method itself is well-known in the art.

As the method of forming a polymer membrane from the coating liquid applied, heating method at a temperature of 300° C. or lower, preferably from 80 to 150° C., for about 2 minutes to one hour is generally employed. Of course it is possible to employ heating at a higher temperature than 300° C. within a range that the paper substrate or the fiber substrate is adversely affected. Further, when the alkoxysilane contains polymerizable unsaturated bonds, it is possible to form additional cross-linking structure with the combination of the heating and UV irradiation.

Then, according to the coated material of the present invention, the polymer membrane having a polysiloxane structure as the main structure may be provided on the surface of one side or both side of the paper substrate or the fiber substrate.

Paper substrates such as cellophane paper, Japanese paper and foreign paper and fiber substrates such as non-woven fabric and cloth which are substrates of the coated material of the present invention, have a thickness of preferably 0.01 mm or above in view of the strength. Then, thickness of the polymer membrane having a polysiloxane structure as the main structure is not particularly limited, however, for example, it is preferred from 2.5 to 25 $\mu$m in view of the oxygen barrier property and heat resistance when it is used as a film or sheet for packing foods, or a food container which is the second or third object of the present invention mentioned below.

As mentioned above, the film or sheet for packing foods of the second object of the present invention is provided which comprises a paper substrate or a fiber substrate, and a polymer membrane having a polysiloxane structure as the main structure provided on the surface of at least one side of the substrate. Then, the food container of the third object of the present invention is provided which is obtained by processing and shaping the film or sheet having the above constitution with a method known per se such as dies cutting, embossing or vacuum forming.

Alternatively, a paper substrate such as cellophane paper may be previously shaped into a food container, the coating liquid mentioned above is applied on the surface of the shaped substrate with a method such as dipping application or splay application, followed by the method as mentioned above to form a polymer membrane having a polysiloxane structure as the main structure.

Such a food container of the present invention is used for a container such as one for microwave oven cooking, a paper cup, one for condiment or one for deodorizer, but not limited thereto. It exhibits an excellent effect that the shape of the container does not impaired at a cooking temperature higher than 200° C. when used for microwave oven cooking.

Then, the fourth object of the present invention is accomplished by processing the above-mentioned film or sheet for packing foods.

Namely, the film or sheet for packing foods which comprises a paper substrate or a fiber substrate , and a polymer membrane having a polysiloxane structure as the main structure provided on the surface of at least one side of the substrate, is processed and shaped with a method known per se such as dies cutting, embossing or vacuum forming to give a protective cover for liquid crystal surface of an electronic device, a transparent pouched article of stationery such as a clear holder or a film case, a transparent container for an aromatic or a water repellent sheet for an automobile side mirror.

The protective cover for liquid crystal surface of an electronic device can be provided by cutting into a predetermined size a coated material having a predetermined thickness which is made with the use of a transparent or translucent paper substrate or the like as the substrate. Further, the transparent pouched article of stationery such as a clear holder or a film case, the transparent container for an aromatic, the water repellent sheet for an automobile side mirror or the like can be provided by cutting into a predetermined size a coated material having a predetermined thickness which is made with the use of a transparent or translucent paper substrate or the like as the substrate, and by making it into a pouched form.

The coated material of the present invention which has a polymer membrane having a polysiloxane structure as the main structure, requires no plasticizer and contains no chlorine atom so that no dioxin is generated by burning it, it being global environmentally friendly. In addition, the polymer membrane having a polysiloxane structure as the main structure provided on the surface of the substrate, imparts to the coated material insulating properties, water repellency, an appropriate strength, good light transmission properties and flame retardancy.

As the result, a film or sheet for packing foods, a food container, a protective cover for liquid crystal surface of an electronic device, a transparent pouched article of stationery such as a clear holder or a film case, a transparent container for an aromatic, a water repellent sheet for an automobile side mirror or the like made of the coated material becomes an excellent product which abounds in insulating properties and water repellency, has an appropriate strength and good light transmission properties, further is rich in flame retardancy.

EXAMPLES

Now, the present invention will be explained in detail based on examples, but the scope of the present invention is not limited by the examples.

Example 1

Preparation and Evaluation of Film or Sheet for Packing Foods (Preparation of coating liquid)

An alkoxysilane mixture of 10 moles of methyltrimethoxysilane, 10 moles of phenyltrimethoxysilane was dissolved in 4 kg of 3-methyl-3-methoxybutanol. To this solution, phosphoric acid aqueous solution (consisting of 60 moles of water and 0.17 mole of phosphoric acid) was added under stirring to prepare Solution (A).

Otherwise, 1 mole of tetrabutoxy zirconium was dissolved in 1,500 g of 3-methyl-3-methoxybutanol, and 5 moles of ethyl acetoacetate was added thereto under stirring. The reaction was proceeded by stirring the resultant solution at room temperature for one hour to prepare Solution (B) containing a chelate compound of zirconium (concentration: 4.7%).

Then, 650 g of Solution (A) and 50 g of Solution (B) were mixed and stirred at room temperature for 2 hours to obtain a homogenous solution. Further, the concentration of solid content in the solution was adjusted to 25% by the use of 3-methyl-3-methoxybutanol to obtain a coating liquid.

(Formation of polymer membrane onto surface of cellophane paper)

The coating liquid as prepared above was applied onto one side of a cellophane paper (brand name: Taiko Cellophane, manufactured by Futamura Kagaku Kogyo Kabushiki Kaisha, 0.03 mm in thickness) with a gravure roll coater, and heated at 150° C. for 3 minutes to form a polymer membrane having a polysiloxane structure as the main structure and having a thickness of 2$\mu$m on the surface of one side of the cellophane paper. The film using the cellophane paper as the substrate, is hereinafter referred to as a modified cellophane paper. The modified cellophane paper had a total thickness of 0.032 mm and was transparent.

(Evaluation of physical properties of modified cellophane paper)

(1) Determination of oxygen permeation rate

The modified cellophane paper mentioned above was stretched over an annulus having a diameter of 11 cm in OXTRAN-100A-S type device (manufactured by Modern Controls). The upper side of the modified cellophane was filled with 100% oxygen gas and the downside with 100% nitrogen gas, and oxygen was permeated to the nitrogen side through the modified cellophane paper. The oxygen permeation rate was determined with measuring the amount of permeated oxygen when it came to saturation. As control tests, a non-modified cellophane paper and a polyvinylidene chloride film (PVDC) were determined for oxygen permeation rate. Results are shown as follows:

(i) Modified cellophane paper: 0.3 cc/atm/$m^2$/24 hours (ii) Non-modified cellophane paper: 1000 cc/atm/$m^2$/24 hours (iii) PVDC: 0.03 cc/atm/$m^2$/24 hours (2) Water vapor permeability The water vapor permeability of the modified cellophane was carried out in accordance with the method described in JIS Z 0208. As control tests, a non-modified cellophane paper and a polyvinylidene chloride film (PVDC) were determined for water vapor permeability. Results are shown as follows:

(i) Modified cellophane paper. 1800 cc/atm/$m^2$/24 hours (ii) Non-modified cellophane paper: upper limit cc/atm/$m^2$/24 hours (iii) PVDC: 2 cc/atm/$m^2$/24 hours (3) Test for gas generated by burning The concentration of hydrogen chloride in the gas generated by burning the modified cellophane paper was measured in accordance with JIS K 7271 (method of analysis for gas generated by burning plastics), but no hydrogen chloride was detected. This result demonstrates that no dioxin is generated by burning the modified cellophane paper prepared in Example 1.

As is apparent from the results above, the modified cellophane paper prepared in Example 1 is an excellent material useful for packing foods.

Example 2

Preparation and Evaluation of Food Container

A transparent cup-shaped container having a size of 35 mm in bottom diameter and 20 mm in height was made of the modified cellophane paper prepared in Example 1. Several pieces of fried chicken were let into this container, and cooked with heat for 3 minutes in a microwave oven (brand name: NE-N255, manufactured by Matsushita Denki Sangyo Kabushiki Kaisha). The temperature of food in the container raised up to 220° C. but substantial change in shape of the container was not observed.

Accordingly, the container prepared in Example 2 is an excellent food container useful for microwave oven cooking.

Example 3

Preparation and Evaluation of Articles (1) other than Food Container

The modified cellophane paper having a predetermined thickness prepared in Example 1 was cut into a predetermined size to use a protective cover for liquid crystal surface of an electronic device. Such a protective cover for liquid crystal surface of an electronic device includes, for example, protective covers for liquid crystal display screens of a mobile phone and a notebook computer, and indication plates (face plates) and plates indicating operation of electrical equipment. Such protective covers or plates having water repellency and water proofing property can be used in place of conventional plastic surface protective covers or plates. In additional, when incinerated, it generates no hazardous waste such as dioxin and is environmentally friendly.

Example 4

Preparation and Evaluation of Articles (2) other than Food Container

The modified cellophane paper having a predetermined thickness prepared in Example 1 was cut into a predetermined size to use a transparent pouched article of stationery such as a clear holder or a film case and further, to use a transparent container for an aromatic or a water repellent sheet for an automobile side mirror.

Such kinds of goods having water repellency and water proofing property are useful for replacements of conventional goods made of transparent vinyl chloride resin and acrylate resin.

Example 5

Coating on Surface of Paper or Fiber Substrate

Polymers shown in Table 1 were supposed as alkoxysilanes of the general formula (1) usable for preparing the coated material of the present invention. Among the polymers shown in Table 1, No. 3 (methyltrimethoxysilane oligomer; MTM), No. 7 (ethyltrimethoxysilane oligomer; ETM) and No. 10 (methyltriethoxysilane oligomer; MTE) were synthesized as mentioned below. Further, polymers shown in Table 2 were synthesized to compare the properties with the polymers shown in Table 1.

Now, columns of Compound 1 in Table 1 describe names of the alkoxysilanes of the general formula (1), and columns of Compound 2 names of the alkoxysilanes of the general formula (2).

TABLE 1

(Examples)

| Coating liquid No. | Compound 1 | | Compound 2 | | Solvent | | Catalyst | | Result |
|---|---|---|---|---|---|---|---|---|---|
| | Compound name | Amount (g) | Compound name | Amount (g) | Compound name | Amount (g) | Compound name | Amount (g) | |
| 1 | MTM | 19.0 | — | — | isopropyl-alcohol | 2.0 | tetrabutoxy zirconium | 0.8 | ○ |
| | | | | | ethylene-glycol | 2.0 | | | |
| 2 | MTM | 19.0 | — | — | isopropyl-alcohol | 2.0 | tetrabutoxy titanium | 0.8 | ○ |
| | | | | | ethylene-glycol | 2.0 | | | |
| 3 | MTM | 19.0 | — | — | isopropyl-alcohol | 2.0 | dibutyltin diacetate | 0.8 | ◎ |
| | | | | | ethylene-glycol | 2.0 | | | |
| 4 | MTM | 14.0 | γ-glycidoxy-propyl trimethoxy-silane | 5.0 | isopropyl alcohol | 2.0 | dibutyltin diacetate | 0.8 | ◎ |
| 5 | MTM | 14.0 | phenyl trimethoxy-silane | 5.0 | isopropyl alcohol | 2.0 | dibutyltin diacetate | 0.8 | ◎ |
| 6 | ETM | 19.0 | — | — | isopropyl alcohol | 2.0 | tetrabutoxy zirconium | 0.8 | ○ |
| | | | | | ethylene-glycol | 2.0 | | | |
| 7 | ETM | 19.0 | — | — | isopropyl alcohol | 2.0 | tetrabutoxy titanium | 0.8 | ○ |
| | | | | | ethylene-glycol | 2.0 | | | |
| 8 | ETM | 19.0 | — | — | isopropyl alcohol | 2.0 | dibutyltin diacetate | 0.8 | ◎ |
| | | | | | ethylene-glycol | 2.0 | | | |
| 9 | ETM | 14.0 | γ-glycidoxy-propyl trimethoxy-silane | 5.0 | isopropyl alcohol | 2.0 | dibutyltin diacetate | 0.8 | ◎ |
| 10 | MTE | 14.0 | phenyl trimethoxy-silane | 5.0 | isopropyl alcohol | 2.0 | dibutyltin diacetate | 0.8 | ◎ |
| 11 | MTE | 19.0 | — | — | isopropyl alcohol | 2.0 | tetrabutoxy zirconium | 0.8 | ○ |
| | | | | | ethylene-glycol | 2.0 | | | |
| 12 | MTE | 19.0 | — | — | isopropyl alcohol | 2.0 | tetrabutoxy titanium | 0.8 | ○ |
| | | | | | ethylene-glycol | 2.0 | | | |
| 13 | MTE | 19.0 | — | — | isopropyl alcohol | 2.0 | dibutyltin diacetate | 0.8 | ◎ |
| | | | | | ethylene-glycol | 2.0 | | | |
| 14 | MTE | 14.0 | γ-glycidoxy-propyl trimethoxy-silane | 5.0 | isopropyl alcohol | 2.0 | dibutyltin diacetate | 0.8 | ◎ |
| 15 | MTE | 14.0 | phenyl trimethoxy-silane | 5.0 | isopropyl alcohol | 2.0 | dibutyltin diacetate | 0.8 | ◎ |
| 16 | MTM | 14.0 | pure water | 5.0 | isopropyl alcohol | 10.0 | 61% $HNO_3$ | 0.1 | ○ |

TABLE 2

(Comparative examples)

| Comparative | Compound 1 | | Compound 2 | | Solvent | | Catalyst | | |
|---|---|---|---|---|---|---|---|---|---|
| Coating liquid No. | Compound name | Amount (g) | Compound name | Amount (g) | Compound name | Amount (g) | Compound name | Amount (g) | Result |
| 1 | methyl trimethoxy-silane | 21.0 | — | — | isopropyl-alcohol<br>ethylene-glycol | 2.0<br>2.0 | tetrabutoxy zirconium | 0.8 | Δ |
| 2 | methyl trimethoxy-silane | 21.0 | — | — | isopropyl-alcohol<br>ethylene-glycol | 2.0<br>2.0 | tetrabutoxy titanium | 0.8 | Δ |
| 3 | methyl trimethoxy-silane | 21.0 | — | — | isopropyl alcohol<br>ethylene-glycol | 2.0<br>2.0 | dibutyltin diacetate | 0.8 | Δ |
| 4 | methyl trimethoxy-silane | 15.0 | γ-glycidoxy-propyl trimethoxy-silane | 5.0 | isopropyl alcohol | 2.0 | dibutyltin diacetate | 0.8 | Δ |
| 6 | MS-51 | 19.0 | — | — | isopropyl alcohol<br>ethylene-glycol | 2.0<br>2.0 | tetrabutoxy zirconium | 0.8 | Δ |
| 7 | MS-51 | 19.0 | — | — | isopropyl alcohol<br>ethylene-glycol | 2.0<br>2.0 | tetrabutoxy titanium | 0.8 | X |
| 8 | MS-51 | 19.0 | — | — | isopropyl alcohol<br>ethylene-glycol | 2.0<br>2.0 | dibutyltin diacetate | 0.8 | X |
| 9 | MS-51 | 14.0 | γ-glycidoxy-propyl trimethoxy-silane | 5.0 | isopropyl alcohol | 2.0 | dibutyltin diacetate | 0.8 | X |
| 11 | ES-40 | 19.0 | — | — | isopropyl alcohol<br>ethylene-glycol | 2.0<br>2.0 | tetrabutoxy zirconium | 0.8 | X |
| 12 | ES-40 | 19.0 | — | — | isopropyl alcohol<br>ethylene-glycol | 2.0<br>2.0 | tetrabutoxy titanium | 0.8 | X |
| 13 | ES-40 | 19.0 | — | — | isopropyl alcohol<br>ethylene-glycol | 2.0<br>2.0 | dibutyltin diacetate | 0.8 | X |
| 14 | ES-40 | 14.0 | γ-glycidoxy-propyl trimethoxy-silane | 5.0 | isopropyl alcohol | 2.0 | dibutyltin diacetate | 0.8 | X |

MS-51: Oligomer of tetramethoxysilane (average polymerization degree of 3 to 4)
ES-40: Oligomer of tetraethoxysilane (average polymerization degree of 3 to 4)

Synthesis of Alkoxysilane Polymer (1) Methyltrimethoxysilane oligomer (MTM)

To a 500 ml three-necked flask, 181 g of methyltrimethoxysilane, 50 g of methanol and 18 g of pure water were charged and fully stirred. Further, 2 g of 61% $HNO_3$ was added thereto and refluxed with heat under stirring for 3 hours. After completion of the reaction, pressure in the flask was decreased under heating to remove methanol.

MTM thus obtained consisted mainly of 3-mer to 4-mer according to the result from gas chromatography analysis.

A paper substrate (steam setting press having a thickness of 0.13 mm, manufactured by Miki Tokushu Seishi) was coated with the coating liquid prepared in this Example. Coating procedure was carried out under conditions that a thickness of the coating liquid was 25 μm on each side of the paper, and drying was carried at 100° C. for 10 minutes, then at 150° C. for 10 minutes. The coated paper having a polymer membrane thus formed had physical properties shown in Table 3.

TABLE 3

| Coated material | Paper or fiber material |
|---|---|
| Test Items | Example 5 |
| Thickness (mm) | 0.137 |

TABLE 3-continued

| Coated material | | Paper or fiber material |
|---|---|---|
| Density (g/cm$^3$) | | 1.278 |
| Tensile strength (kg/mm$^2$) | Longitudinal | 22.3 |
| | Transversal | 4.2 |
| Elongation (%) | Longitudinal | 4.1 |
| | Transversal | 12.1 |
| Dielectric breakdown strength (Kv/mm) | Ordinary temperature | 45.1 |
| | After heating | 44.0 |
| Surface resistivity (MΩ) | Ordinary temperature | $1.1 \times 10^7$ |
| | After moisture absorption | $2.2 \times 10^8$ |
| Volume resistivity (MΩ · cm) | Ordinary temperature | $2.3 \times 10^7$ |
| | After moisture absorption | $3.4 \times 10^8$ |
| One hour water absorption (%) | | 50.3 |
| Flame retardancy (UL gauge) | | equivalent of 94 HB |

In Table 3, thickness, density, tensile strength and dielectric breakdown strength were measured in accordance with JIS C 2315. Surface resistivity and volume resistivity were measured in accordance with JIS K 6911. One hour water absorption was measured in accordance with Electrical Appliance and Material Control Law. "After heating" means a value measured after heating at 105° C. for 24 hours followed by cooling under 0% moisture content. "After moisture absorption" means a value quickly measured after absorbing moisture under 90% RH at 40° C. for 24 hours.

As is apparent from the results shown in Table 3, by the use of the coating liquid prepared in Example 5, a coated material having excellent properties for packing food can be provided.

(2) Ethyltrimethoxysilane oligomer (ETM)

To a 500 ml three-necked flask, 200 g of ethyl trimethoxysilane, 50 g of methanol and 18 g of pure water were charged and fully stirred. Further, 2 g of 61% $HNO_3$ was added thereto and refluxed with heat under stirring for 7 hours. After completion of the reaction, pressure in the flask was decreased under heating to remove methanol.

ETM thus obtained consisted mainly of 3-mer to 4-mer according to the result from gas chromatography analysis.

(3) Methyltriethoxysilane oligomer (MTE)

To a 500 ml three-necked flask, 273 g of methyl triethoxysilane, 50 g of ethanol and 18 g of pure water were charged and fully stirred. Further, 2 g of 61% $HNO_3$ was added thereto and refluxed with heat under stirring for 12 hours. After completion of the reaction, pressure in the flask was decreased under heating to remove ethanol.

MTE thus obtained consisted mainly of 3-mer to 4-mer according to the result from gas chromatography analysis.

EFFECT OF THE INVENTION

The coated material wherein a polymer membrane having a polysiloxane structure as the main structure provided on the surface of the substrate, is a novel material which abounds in the insulating properties and water repellency, has an appropriate strength and good light transmission properties, further is rich in flame retardancy while it is a global environmentally friendly material because when incinerated, it is free from care about generation of dioxin or environmental hormones. The coated material is not only; useful for a replacement material of conventional paper or fiber material but also a material suitable for sheet or film for packing foods.

The film or sheet for packing foods of the present invention wherein a polymer membrane having a polysiloxane structure as the main structure provided on the surface of the substrate, has oxygen barrier property, whereby no oxidization of food contained therein, breeding of aerobic bacteria and corruption do not take place. Further, development of fungi can be controlled. Furthermore, it is free from care about generation of dioxin or environmental hormones.

The food container of the present invention can be used for a container in which food contained is cooked at a higher temperature than 200° C. with a microwave oven, and is transparent. It is also free from care about generation of dioxin or environmental hormones.

Further, when used as a protective cover for liquid crystal surface of an electronic device or the like, it is also free from care about generation of dioxin or environmental hormones.

What is claimed is:

1. A transparent article comprising a cellophane substrate coated on at least one surface thereof with a polymeric coating, said coating obtained by applying a coating liquid comprising (A) at least one alkoxysilane of the formula (1):

(1)

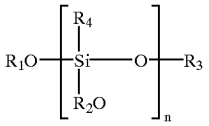

(wherein $R_1$, $R_2$, $R_3$, and R4 are the same or different, and each is a hydrogen atom or an alkyl group having 1 to 4 carbon atoms, and n is an integer of 2 to 8);

and optionally (B) at least one alkoxysilane of the formula (2):

(2)

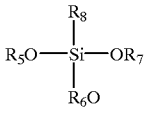

(wherein $R_5$, $R_6$ and $R_7$ are the same or different, and each is a hydrogen atom, an alkyl group having 1 to 10 carbon atoms or an alkenyl group having 1 to 10 carbon atoms, and $R_8$ is an alkyl, alkenyl or phenyl group which may be substituted by an epoxy or a glycidyl), or a condensate of said least one alkoxysilane of the formula (2) (wherein $R_5O$, $R_6O$ and $R_7O$ represent siloxane bonds, respectively);

and (C) a hydrolyzable organometal compound catalyst, on said substrate, and heating said coating liquid to form said polymeric coating.

2. The transparent article according to claim 1, wherein said hydrolyzable organometal compound contains a metal component selected from the group consisting of titanium, zirconium, aluminum and tin.

3. The transparent article according to claim 2, wherein said hydrolyzable organometal compound is a chelate.

4. The transparent article according to claim 1, which is in the form of a film or sheet.

5. The transparent article according to claim 2, which is in the form of a film or sheet.

6. The transparent article according to claim 3, which is in the form of a film or sheet.

7. The transparent article according to claim 1, which in the form of a container adapted for holding food.

8. The transparent article according to claim 2, which is in the form of a container adapted for holding food.

9. The transparent article according to claim 3, which is in the form of a container adapted for holding food.

10. A protective cover adapted for protecting a liquid crystal surface of an electronic device, wherein said protective cover is made from a material comprising the film or sheet of claim 4.

11. A protective cover adapted for protecting a liquid crystal surface of an electronic device, wherein said protective cover is made from a material comprising the film or sheet of claim 5.

12. A protective cover adapted for protecting a liquid crystal surface of an electronic device, wherein said protective cover is made from a material comprising the film or sheet of claim 6.

13. A transparent pouched article or container, wherein said transparent pouched article or container is made from a material comprising the film or sheet of claim 4.

14. A transparent pouched article or container, wherein said transparent pouched article or container is made from a material comprising the film or sheet of claim 5.

15. A transparent pouched article or container, wherein said transparent pouched article or container is made from a material comprising the film or sheet of claim 6.

* * * * *